US006506327B2

(12) United States Patent
Weihrauch

(10) Patent No.: US 6,506,327 B2
(45) Date of Patent: Jan. 14, 2003

(54) PROCESS OF MAKING MONOFILAMENTS

(75) Inventor: Georg Weihrauch, Wald-Michelbach (DE)

(73) Assignee: Pedex & Co. GmbH, Wald-Michelbach (DE)

( * ) Notice: Subject to any disclaimer, the term of this patent is extended or adjusted under 35 U.S.C. 154(b) by 0 days.

(21) Appl. No.: 09/995,700

(22) Filed: Nov. 29, 2001

(65) Prior Publication Data

US 2002/0034636 A1 Mar. 21, 2002

Related U.S. Application Data

(63) Continuation of application No. 09/530,243, filed as application No. PCT/EP98/06954 on Nov. 3, 1998.

(30) Foreign Application Priority Data

Nov. 5, 1997 (DE) ..... 197 48 733

(51) Int. Cl.[7] ..... D01D 5/253; D01D 5/32; D01D 5/34; D01D 5/36; D02J 3/02

(52) U.S. Cl. ..... 264/146; 264/148; 264/162; 264/172.12; 264/172.13; 264/172.14; 264/172.15; 264/172.17; 264/172.18

(58) Field of Search ..... 264/146, 148, 264/162, 172.12, 172.13, 172.14, 172.15, 172.17, 172.18

(56) References Cited

U.S. PATENT DOCUMENTS

| | | | | |
|---|---|---|---|---|
| 3,117,362 A | | 1/1964 | Breen | |
| 3,173,163 A | | 3/1965 | Cramton | |
| 4,821,359 A | * | 4/1989 | Deziel et al. | 15/159.1 |
| 5,128,208 A | | 7/1992 | Bond et al. | |

FOREIGN PATENT DOCUMENTS

| | | |
|---|---|---|
| DE | 23 07 324 A | 9/1973 |
| DE | 195 33 815 A1 | 3/1997 |
| DE | 297 00 611 U1 | 4/1997 |
| EP | 450 210 A1 | 10/1991 |
| JP | 21 69 720 A | 6/1990 |
| JP | 21 69 722 A | 6/1990 |
| JP | 21 69 723 A | 6/1990 |
| JP | 3 199 424 A | 8/1991 |
| JP | 3 199 425 A | 8/1991 |
| JP | 3 199 426 A | 8/1991 |
| JP | 5 518 18 A | 3/1993 |
| JP | 533 17 73 A | 12/1993 |
| JP | 533 17 74 A | 12/1993 |
| JP | 533 17 75 A | 12/1993 |
| JP | 7 197 322 A | 8/1995 |
| JP | 828 40 19 A | 10/1996 |
| WO | WO92 10 114 A1 | 6/1992 |
| WO | WO96 39 117 A2 | 12/1996 |
| WO | WO96 41 041 A1 | 12/1996 |
| WO | WO97 148 30 A1 | 4/1997 |
| WO | WO98 48 086 A1 | 10/1998 |

OTHER PUBLICATIONS

Abstract of JP 73037045 B (1973), Derwent–Acc–No: 1973–69071U.*

Abstract of JP 74018988 B (1974), Derwent–Acc–No: 1974–42865V.*

* cited by examiner

*Primary Examiner*—Leo B. Tentoni
(74) *Attorney, Agent, or Firm*—Paul Vincent

(57) ABSTRACT

In a method for producing a monofilament with reduced secondary binding forces of at least two commonly extruded polymers for the production of bristles or interdental cleaners which are slittable substantially axially through the action of mechanical forces, the at least two polymers of the monofilament are disposed in a regular geometrical arrangement with substantially axially extending boundary layers in which the reduced secondary binding forces prevail for generation of defined slits of flags.

22 Claims, 2 Drawing Sheets

PROCESS OF MAKING MONOFILAMENTS

This application is a continuation of Ser. No. 09/530,243 filed Apr. 29, 2000, now abandoned, which is based on PC7/EP98/06954 filed Nov. 3, 1998 and claims Paris Convention priority of German patent application 197 48 733.5 filed Nov. 5, 1997 the complete disclosure of which are hereby incorporated by reference.

BACKGROUND OF THE INVENTION

The invention relates to a monofilament with reduced secondary binding forces having at least two polymers commonly extruded in regular geometric relationship with substantially axially extending border surfaces for producing bristles or interdental cleaners, which are substantially axially slittable by the action of mechanical forces. The invention relates to a method for producing bristles or interdental cleaners from such monofilaments as well as to brush-ware with such bristles and to interdental cleaners.

Bristles for brushware of all types, e.g. personal hygiene and tooth-brushes, household brushes, industrial brushes, paint brushes, etc., are mainly produced from polymers, in that the polymer melt is extruded into continuous monofilaments, the monofilaments are stretched and optionally stabilized. The bristles are then produced from such monofilaments by cutting to the desired length. As a rule, the monofilaments, like the bristles, have a circular cylindrical cross-section. For special applications bristles with a different cross-section are known, e.g. an oval or polygonal cross-section. The monofilaments are then extruded with a corresponding profile.

In many cases it is desirable to use bristles having a fibrous and preferably fine fibrous structure at the use end. This e.g. applies for brushware intended for the application of media to surfaces or the like, e.g. paint brushes. Even if a fleecy structure is sought, the bristle must be of a fine fibrous nature. Of late in the dental sector it has been found that conventional bristles of toothbrushes have inadequate cleaning action, because they do not penetrate into the fine cracks of the tooth surface and instead slide over same. Much the same applies for the cleaning action in the interdental space.

In order to obtain a highly fibrous structure, proposals have already been made for extruding the monofilament from polymer blends. During the extrusion and subsequent stretching of the monofilament, the polymer molecules are oriented in the longitudinal direction of the monofilament. The primary binding forces acting in the longitudinal direction ensure high tensile strength. The longitudinal orientation of the molecules also effects the desired flexural elasticity. In monofilaments made from a single polymer, the so-called secondary binding forces, namely the forces transverse to the molecular extension, are adequate in order to prevent a unraveling or cleaving of the monofilament or bristle. In the case of monofilaments from two different, blended polymers, sliding zones, in which the secondary binding forces are reduced, occur between the molecular chains of the polymers during stretching. Such a monofilament or a bristle produced therefrom can be unraveled by the action of mechanical forces using knife-like tools. The resulting flags have a very irregular shape, irregular cross-sections and frayed peripheral surfaces. Although a larger bundle of such bristles is fleecy and of good absorbing structure, the flags have uncontrolled strength characteristics. They tear out, break off or wrap round. Such unraveled bristles are consequently unsatisfactory and are even unusable for many applications. For hygienic reasons their use in toothbrushes is risky.

The same disadvantages are encountered in a known bristle structure (WO97/14830) which has a core and an envelope, which are produced by the coextrusion of two different polymers. The core material is mechanically or chemically removed at the use-side end of the bristle in order to form a deep pocket, which is intended to receive a dentifrice or paint. In addition, flags can be obtained by unraveling the envelope material to the extent that it projects over the core. This unraveling takes place in a conventional manner by cutting with knives. The bristles obtained show the same irregular structure mentioned above.

Particularly for toothbrushes, bristles have already been proposed which comprise a plurality of such fibers, similar to textile fibers, and an envelope jacketing the fibers (DE 94 08 268 U1). The envelope and fibers can be coextruded as a filament. After cutting the bristle to length, the envelope is removed at the use-side end of the bristle by mechanical working or cutting, so that the fibers are free over a short length. Quite apart from the complicated production of such bristles, they can only be used to a limited extent. It is particularly disadvantageous that there is a sudden change in the bending behavior at the transition between the fibers and the envelope. If such bristles are used in applicators, there can be damage to the surface due to the hard transition. The same applies when such bristles are used in toothbrushes in connection with the action on the teeth and gums. In addition, the fibers are bending-limp, so that they do not or do not adequately penetrate into deeper cavities, intendental spaces etc. In case of permanent stressing, the fibers also easily break off at the edge of the envelope.

WO96/39117 discloses an intendental cleaner made from monofilaments which are co-extruded in defined geometric relationship. Each monofilament comprises at least two polymer components leading to reduced secondary binding forces at the borders between neighboring monofilaments. The secondary forces are reduced through the action of axial tensile forces to produce a multi-fibered fleecy structure similar to that of dental floss.

Conventional textile fibers (U.S. Pat. No. 3,117,362) are produced having glossy, sharp-cornered structures by co-extruding various polymers, each of which has a suitable cross sectional shape, which bond to each other at their bordering surfaces and which are separated through introduction of a solvent which dissolves one of the polymers.

The problem of the invention is to propose a monofilament of at least two commonly extruded polymers, which is suitable for producing slitted bristles or interdental cleaners with reproducible strength characteristics and flags or slits which are definable according to number, shape and dimension. The invention is directed to a method for the production of bristles or interdental cleaners from such monofilaments.

SUMMARY OF THE INVENTION

A monofilament solving this problem is characterized in accordance with the invention in that the border surfaces are border layers having reduced secondary binding forces, wherein the monofilament comprises a matrix of polymers whose physical and chemical properties define the properties of the bristle or interdental cleaner. A second polymer is imbedded as a thin layer into the matrix.

As a result of the geometry of the boundary layers it is possible to forecast in what way the monofilament for example for an interdental cleaner or the bristle produced from the monofilament by cutting to length will be disintegrated or split by the action of mechanical forces. The slits or flags occur precisely with the predetermined contour given by the extrudate geometry. As the boundary layers extend in the longitudinal direction of the monofilament, each flag has a constant shape and cross-section along its entire length. Thus, the flags have the same strength characteristics, in particular, identical bending behavior and identical tensile strength. By appropriately defining the geometry, flags can also be produced with different cross-sections. Since the monofilament or bristle, under the action of mechanical forces, splits exclusively and precisely at the boundary layers, the flags can have edges at their facing surfaces in dependence on the thin layer array to assist the cleaning action. A bristle split in this way is consequently more effective at its peripheral surface than conventional spreading of the bristle flags. The congruent shapes prevent excessive spreading of the bristles. In a densely packed bundle, each bristle once more acquires a monofilament-like shape and the full effect of the flags only results from the axial or radial pressure. Media can thereby be well absorbed and delivered on application by pressure action.

This makes it possible to produce bristles, whose flags have the desired characteristics of conventional bristles comprising the matrix polymer. Since splitting separates the thin layer into residual waste remnants which may or may not cling to the matrix material flags, no or few sharp structures are formed and there is no need for extensive cleaning of the split bristle. Accurately flagged and slit monofilaments for interdental cleaners are obtained, with which the propagation of splitting or slitting can be avoided.

The polymer of the matrix as well as of the thin layers can also be a copolymer or a polymer blend. These aforementioned advantages are achieved in a particularly optimum form if the thin layers at least partly comprise the polymer of the matrix. In this case the polymer or the bristle tears at the weakest point when force is exerted, namely roughly in the center of the thin layers, but the adhesiveness of the part of the matrix polymer in the thin layer at the resulting, neighboring flags is adequate to avoid the formation of sharp structures.

The thin layers preferably have a thickness of a few $\mu$m. Since monofilaments for brushes have diameters typically ranging from 0.2 mm to 1.2 mm, the thin layers have a thickness which is small compared to the diameter of the monofilament. Practical extrusion tests have revealed that such thin layers can be coextruded together with the polymer of the matrix.

The two polymers can be present in roughly equal parts in the thin layers.

The specific definition of the geometry is determined by the desired characteristics of the bristle and interdental cleaner. Thus, the thin layers in the matrix can extend to the circumference of the monofilament, so that the monofilament can be split or slit with a relatively limited force action.

Alternatively, the thin layers can terminate in the matrix at a separation from the periphery of the monofilament. In this case a somewhat greater force action is required, but it is advantageous that the resulting flags, also in the edge region, comprise the matrix material, i.e. have the same wear characteristics as the envelope of the bristle or the flags.

Optionally the monofilament matrix can have a third polymer incorporated into said matrix and which is mainly used for influencing the strength characteristics of the resulting flags.

As is normally the case with bristles, the monofilament can be circular, but can also have a non-circular cross-section. Particular mention is made of polygonal cross-sections, which are more effective in their cleaning action than circular cross-sections.

In this case the thin layers can extend to the corners of the polygonal cross-section, so as to give relatively sharp edges with an edge angle of less than 90°.

Alternatively, the thin layers can also extend to the surfaces of the polygonal cross-section. It is then possible to obtain edges with an angle of approximately 90°.

According to a preferred development the matrix comprises a polyamide and the thin layers a polyolefine, particularly polypropylene or polyethylene. This material combination has secondary binding forces at the interfaces which are sufficient to prevent an untimely tearing or unraveling during processing and use of the bristles. However, the polymer union tears in the case of a strong, planned application of force.

The method according to the invention for producing bristles from the aforementioned monofilament comprises the following steps: coextruding the at least two polymers into a monofilament, stretching and optionally stabilizing the monofilament, cutting the monofilament to bristles of the desired length, splitting the bristles at their use ends along the boundary layers along a limited length by the action of mechanical forces acting transversely to the axis of the bristle.

Another method suitable for producing bristles as well as interdental cleaners from the aforementioned monofilament comprises the following steps: coextruding the at least two polymers into a monofilament, slitting, following extrusion, stretching and optically stabilizing, the monofilament along the boundary layers on a locally limited length for forming short slits by the action of mechanical forces acting transversely to the axis of the monofilament. With the method in accordance with the invention, crack-like slits can be formed in the monofilament envelope and these can be used for receiving media. In the case of toothbrushes or interdental cleaners these can be dentifrices or dental or antibacterial preparations. As a result of the slitting action, the monofilaments envelope has an increased roughness.

Interdental cleaners of any length can be manufactured from the monofilament described above. The same measure can naturally be carried out on the bristle cut to length from the monofilament. The location of slitting and the extension of the slits can be matched to the bristle length, in order to either prevent or encourage planned splitting of the bristle end. For example, only the bristle end may be split The slits made on the envelope can be used for the further splitting of the bristle following the wearing away of the flags. As a function of the nature and number of incorporated layers, a corresponding number of flags is formed at the use end of the bristle.

For processing monofilaments into interdental cleaners of any length, a variation of the method provides for compressing the monofilament in its axial direction during or after the action of the mechanical forces. The lengthwise slitted areas and the strips limiting the slits respectively are thereby bulged.

The mechanical forces are preferably applied to a greater part of the periphery of the monofilament or bristle to ensure that all the boundary layers of the polymers are effected.

The slitting of the monofilament or the splitting of the bristles preferably takes place by impact forces. Alternatively, squeezing or torsional forces can also be used. These forces can be applied to the cut to length bristle or also simultaneously to groups of bristles, e.g. bristle bundles, before or after the fixing thereof to the bristle carrier of the brush.

The bristles are preferably rounded at their use-side ends. This can take place before and/or after splitting. In accordance with a further preferred embodiment of the method, the several ends obtained after splitting are provided with a marking optically indicating the usable length. This indicates to the user that the bristle has become worn up to the marking, i.e. following the wearing of the split ends the use characteristics suddenly change, since the much stiffer cross-section of the entire bristle is then effective. The split ends also become ever shorter and consequently mechanically more aggressive. Such an indication is particularly appropriate in the case of toothbrushes, personal hygiene brushes, etc.

The invention is described in greater detail hereinafter relative to embodiments and the attached drawings, wherein:

DESCRIPTION OF THE PREFERRED EMBODIMENT

Figure 1:
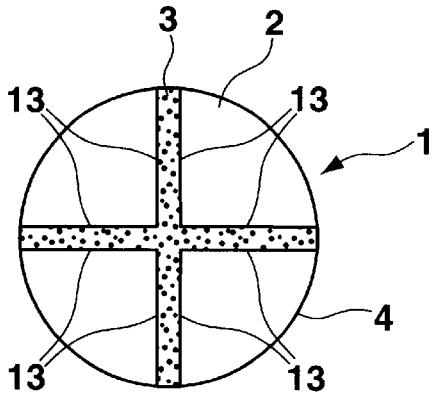
FIG. 1 shows a first cross section of a first monofilament in accordance with the invention.

The monofilament 1 according to FIG. 1 has a circular cross-section and is produced by coextrusion of at least two polymers. It comprises a matrix 2 of a polymer determining the characteristics of the bristle and thin layers 3 incorporated in a geometrical shape, in this case in the shape of a cross and which comprise a different polymer or a blend thereof with the polymer of matrix 2. The secondary binding forces, i.e. binding forces at right angles to the longitudinal extension of the monofilament, are reduced in the regions of the thin layers 3 or the borders 13 of the matrix 2. In the represented embodiment the thin layers 3 extend to the peripheral surface 4 of the monofilament, but can also terminate at a short distance therefrom.

The polymer for matrix 2 can be polyamide (PA), whereas the thin layers 3 may comprise a PA/PP or PA/PE polymer blend.

Figure 2:
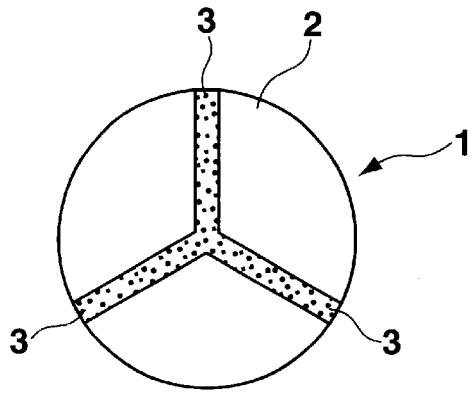
FIG. 2 shows a second cross section of a second monofilament in accordance with the invention.
Figure 3:
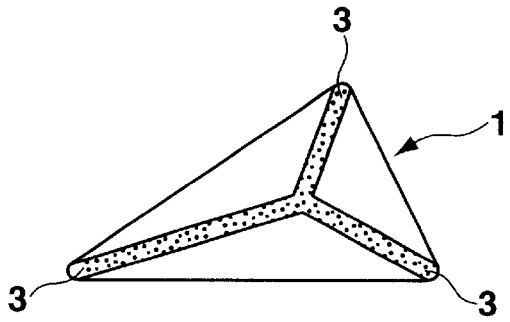
FIG. 3 shows a third cross section of a third monofilament in accordance with the invention.

In the embodiment according to FIG. 2, the thin layers 3 are incorporated into the matrix 2 in the form of a three-armed star. FIG. 3 shows a monofilament 1 with a polygonal, namely triangular cross-section. In this embodiment, the incorporated thin layers extend outwards from the center into the corners of the polygon. Clearly, they can also terminate on the surfaces between the corners.

Figure 4:
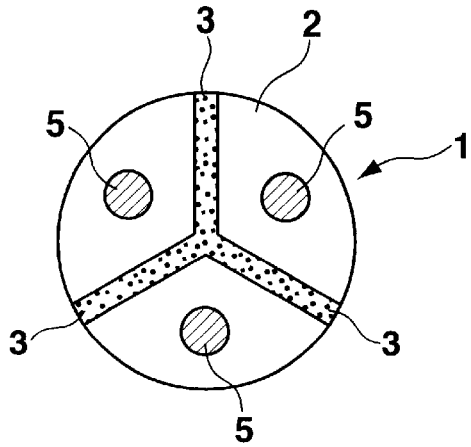
FIG. 4 shows a fourth cross section of a fourth monofilament in accordance with the invention.

In the embodiment according to FIG. 4, a further polymer from among the several possible polymers is extruded together with matrix 2 of the monofilament 1 in such a way that it is fully incorporated into the matrix. For example, these can be thread-like structures 5, which, following the production of the bristle or the splitting or slitting thereof, influence the bending behavior or strength of the resulting flags.

Figure 5:
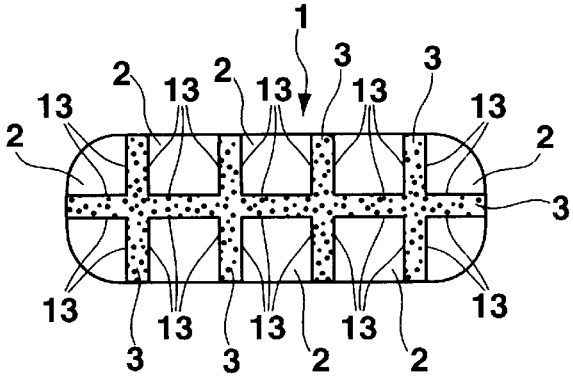
FIG. 5 shows a fifth cross section of a fifth monofilament in accordance with the invention.
Figure 8:
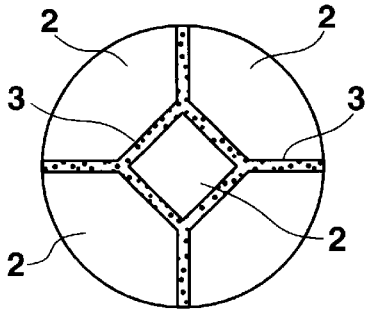
FIG. 8 shows a further form of the cross-section of a monofilament.

FIG. 5 shows a flat, rectangular monofilament 1, in which the thin layers 3 are applied in grid or raster-like manner, so that a plurality of substantially rectangular flags can be produced from the monofilament. Finally, FIG. 8 illustrates a cross section through a monofilament with which the matrix 2 comprises four equal outer portions having circular segment cross sections and a central core which are bordered by correspondingly disposed thin layers 3.

Figure 6:
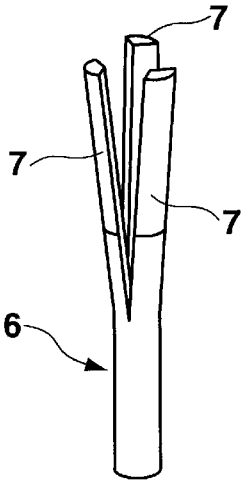
FIG. 6 shows a view of a bristle with a split, use-side end.

FIG. 6 diagrammatically shows a bristle 6, produced by cutting a monofilament e.g. of FIG. 2 to length, which is split on its use-side end by the action of mechanical forces, so that individual flags 7 are obtained, whose shape corresponds to that of the monofilament areas forming the matrix 2. The same number of flags are formed as the matrix 2 is divided up by thin layers 3. The usable length of the flags can be optically marked by a transverse line shown in FIG. 6.

Figure 7:
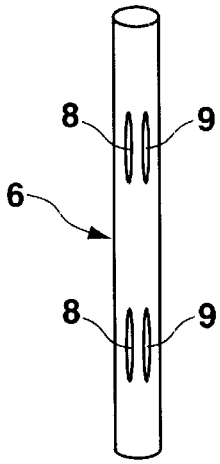
FIG. 7 shows a bristle or interdental cleaner with a slit envelope.

In the embodiment of FIG. 7, the mechanical forces are applied to the peripheral surface of a monofilament with identical spacings or to bristles at a distance from the use-side end. Through the thickness of the layers and the magnitude of the force and/or the frequency of its application, it is possible to ensure that the envelope of the monofilament or the bristle 6 only tears over a locally limited length and that slits 8, 9 and 10 are formed. These slits are substantially in a row, namely in the areas formed by the thin layers 3. In this variant the slits tear at the bristle end, accompanied by the formation of flags. The flags constantly re-form as the bristle wear increases.

Figure 9:
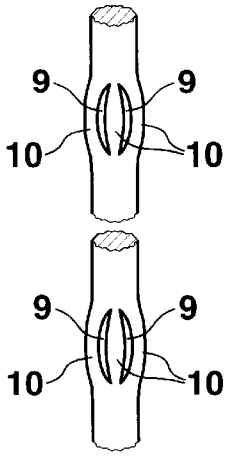
FIG. 9 shows a view of an interdental cleaner in an alternative form.

The monofilament according to FIG. 7 can be used with any desired length as an interdental cleaner (dental floss). The slits can receive dentifrice, antiseptics or antibacterial agents. In the case of a interdental cleaner it is recommendable to axially load the monofilament as shown in FIG. 9 so that the matrix strips 10 delimiting the slits 9 are bulged outwardly.

In all the embodiments shown, the matrix polymer can be dyed with different colors in the various cross-section parts 2 delimited by the thin layers 3.

I claim:

1. A method for producing monofilaments, the method comprising the steps of:

a) extruding the monofilament by co-extruding a matrix containing a first polymer together with thin layers containing a second polymer, said matrix determining physical and chemical characteristics of the monofilament, said thin layers disposed within said matrix in regular geometric configuration and extending in a substantially axial direction of the monofilament, said thin layers having reduced secondary binding forces;

b) stretching the monofilament; and c) applying mechanical forces transverse to an axis of the monofilament to slit said stretched monofilament along said thin layers through a locally limited length to form short slits, thereby preparing flags substantially from said matrix.

2. The method of claim 1, wherein said monofilament is one of compressed in said axial direction during action of said mechanical forces and compressed in said axial direction after action of said mechanical forces.

3. The method of claim 1, wherein mechanical forces act on a greater part of a circumference of said monofilament.

4. The method of claim 1, wherein said monofilament is one of split and slit by impact forces.

5. The method of claim 1, wherein said monofilament is one of split and slit by squeezing forces.

6. The method of claim 1, wherein said monofilament is one of split and slit by torsion forces.

7. The method of claim 1, further comprising rounding a use-side end of said monofilament prior to splitting.

8. The method of claim 1, further comprising rounding a use-side end of said monofilament after splitting.

9. The method of claim 1, further comprising providing a plurality of flags of said monofilament with a marking at a distance from their ends to optically indicate a usable length.

10. The method of claim 1, wherein said matrix comprises a copolymer or a polymer blend.

11. The method of claim 1, wherein said thin layers comprise a copolymer or a polymer blend.

12. The method of claim 1, wherein a portion of said thin layers comprise said first polymer.

13. The method of claim 12, wherein said thin layers comprise approximately equal amounts of said first polymer and said second polymer.

14. The method of claim 1, wherein said thin layers extend up to a circumference of the monofilament.

15. The method of claim 1, wherein said matrix further comprises a third polymer incorporated therein.

16. The method of claim 1, wherein said matrix has a first color and said thin layers have a second color differing from said first color.

17. The method of claim 1, wherein the monofilament has a cross-section diverging from a circular shape.

18. The method of claim 17, wherein the monofilament has a polygonal cross-section.

19. The method of claim 18, wherein said thin layers extend to corners of said polygonal cross-section.

20. The method of claim 18, wherein said thin layers extend to surfaces of said polygonal cross-section.

21. The method of claim 1, wherein said matrix comprises a polyamide and said thin layers comprise a polyolefin.

22. A method for producing bristles from monofilaments, the method comprising the steps of:

a) extruding a monofilament by co-extruding a matrix containing a first polymer together with thin layers containing a second polymer, said matrix determining physical and chemical characteristics of said monofilament, said thin layers disposed within said matrix in regular geometric configuration and extending in a substantially axial direction of said monofilament, said thin layers having reduced secondary binding forces;

b) stretching said monofilament;

c) cutting said stretched monofilament to bristles of a desired length; and d) applying mechanical forces transverse to an axis of the monofilament or bristle to slit said monofilament or bristle along said thin layers through a locally limited length to form short slits, thereby preparing flags substantially from said matrix.

* * * * *